United States Patent [19]

Mase et al.

[11] Patent Number: 5,020,969

[45] Date of Patent: Jun. 4, 1991

[54] TURBO VACUUM PUMP

[75] Inventors: Masahiro Mase, Tochigi; Seiji Sakagami; Takeshi Okawada, both of Ibaraki; Shinjiroo Ueda, Abiko; Yoshihisa Awada; Takashi Nagaoka, both of Ibaraki, all of Japan

[73] Assignee: Hitachi, Ltd., Tokyo, Japan

[21] Appl. No.: 409,720

[22] Filed: Sep. 20, 1989

[30] Foreign Application Priority Data

Sep. 28, 1988 [JP] Japan ..... 63-240727
Apr. 4, 1989 [JP] Japan ..... 1-83921

[51] Int. Cl.[5] ..... F04D 29/00; F01D 1/00

[52] U.S. Cl. ..... 415/55.3; 415/55.1

[58] Field of Search ..... 415/219.1, 55.1, 55.2, 415/55.3, 55.4, 55.5, 55.6, 55.7, 90

[56] References Cited

U.S. PATENT DOCUMENTS 4,668,160 5/1987 Mase et al. ..... 415/90
4,734,018 3/1988 Taniyama et al. ..... 415/112
4,826,394 5/1989 Lotz ..... 415/90

FOREIGN PATENT DOCUMENTS 29796 2/1987 Japan .
113887 5/1987 Japan .
0258186 11/1987 Japan ..... 415/90
147989 6/1988 Japan .
0154891 6/1988 Japan ..... 415/90
0159695 7/1988 Japan ..... 415/90

*Primary Examiner*—John T. Kwon
*Assistant Examiner*—Hoang Nguyen
*Attorney, Agent, or Firm*—Antonelli, Terry, Stout & Kraus

[57] ABSTRACT

Since a peripheral-flow pump according to the present invention has a peripheral-flow impeller having a cylindrical staircase shape whose outer diameter increases in one direction only like a staircase, a stator, which conventionally has been of a complicated configuration composed of two pieces, can be formed into an integral molding without any deterioration in pump performance. Accordingly, the production of pumps is facilitated.

30 Claims, 9 Drawing Sheets

TURBO VACUUM PUMP

BACKGROUND OF THE INVENTION

1. Field of the Invention

The present invention relates to a turbo vacuum pump.

2. Description of the Related Art

A conventional turbo vacuum pump in which atmospheric pressure is maintained in its outlet port is proposed in, for example, Japanese Patent Unexamined Publication No. 62-113887.

In this conventional turbo vacuum pump, a first impeller and a diffuser fixing plate are arranged in the axial direction, and second impellers and fixing plates are arranged alternately. For this reason, the diffuser fixing plate and the fixing plates must be formed as two-piece fitting structures.

In general, in order to attain satisfactory pump performance, the above turbo vacuum pump must be made to maintain a predetermined small gap between the impellers and the respective fixing plates, particularly between the second impellers and the fixing plates. However, in the case of the two-piece fitting structures of the fixing plates, the processing accuracy is difficult to maintain because of the complex construction, and the above small gap for the pump performance may not be insured.

In the proposed type described in, for example, Japanese Patent Unexamined Publication No. 62/29796, radial blades are in general employed and compressing operation is effected by forming a swirl by the action of, primarily, centrifugal force.

In the other proposed type described in Japanese Patent Unexamined Publication No. 63/147989, each blade is in general a forward arc blade, and a flow is deflected by means of the blades to form a swirl, thereby achieving compressing operation.

Although the prior art arrangement disclosed in Japanese Patent Unexamined Publication No. 62/29796 effects compressing operation by sufficiently utilizing centrifugal force, the function of the blades, that is, the function of deflecting a flow is not taken into account. Accordingly, this prior art has the problem that the compression ratio of the centrifugal-flow pump cannot be increased so as to achieve high performance.

Although the prior art arrangement disclosed in Japanese Patent Unexamined Publication No. 63/147989 effects compressing operation by sufficiently utilizing the function of blades, the utilization of centrifugal force is not taken into account. Accordingly, this prior art has the problem that the compression ratio of the centrifugal-flow pump cannot be increased so as to achieve high performance.

SUMMARY OF THE INVENTION

Oject of the Invention

It is, therefore, one object of the present invention to provide a turbo vacuum pump whose production and dimensional control are facilitated so that variations in pump performance due to various factors of a production process can be minimized.

It is another object of the present invention to provide a turbo vacuum pump having higher pump performance as compared to conventional turbo vacuum pumps.

STATEMENT OF THE INVENTION

To achieve the above objects, in accordance with the present invention, there is provided a turbo vacuum pump which includes a peripheral-flow impeller comprising a rotary element which is shaped into a conical configuration having a staircase-shaped outer circumference and comprising a plurality of blades secured to portions adjacent to the projecting edges of the respective steps of the rotary element. The stator is opposed to the peripheral-flow impeller with a small gap therebetween, and a peripheral-flow-pump flow passage is defined along a concave portion of each of the steps of the staircase-shaped inner circumference to provide serial communication between the peripheral-flow-pump flow passages of individual pump stages so that the peripheral-flow-pump flow passages are integrally formed.

To achieve the above objects, in accordance with the present invention, there is provided an improvement in a turbo vacuum pump which comprises a casing having an inlet port and an outlet port and multiple stages of pumps disposed in the casing in the axial direction, each of the pumps including a rotor and a stator opposed to the rotor, the turbo vacuum pump being arranged to suck a gas through the inlet port and discharge the air through the outlet port under atmospheric pressure. The improvement comprises a peripheral-flow pump including blades formed on portions extending from the rotor in the axial direction and peripheral flow passages defined along the circumferential portions of stator opposed to the blades in the axial direction.

DESCRIPTION OF THE PREFERRED EMBODIMENTS

Figure 1:
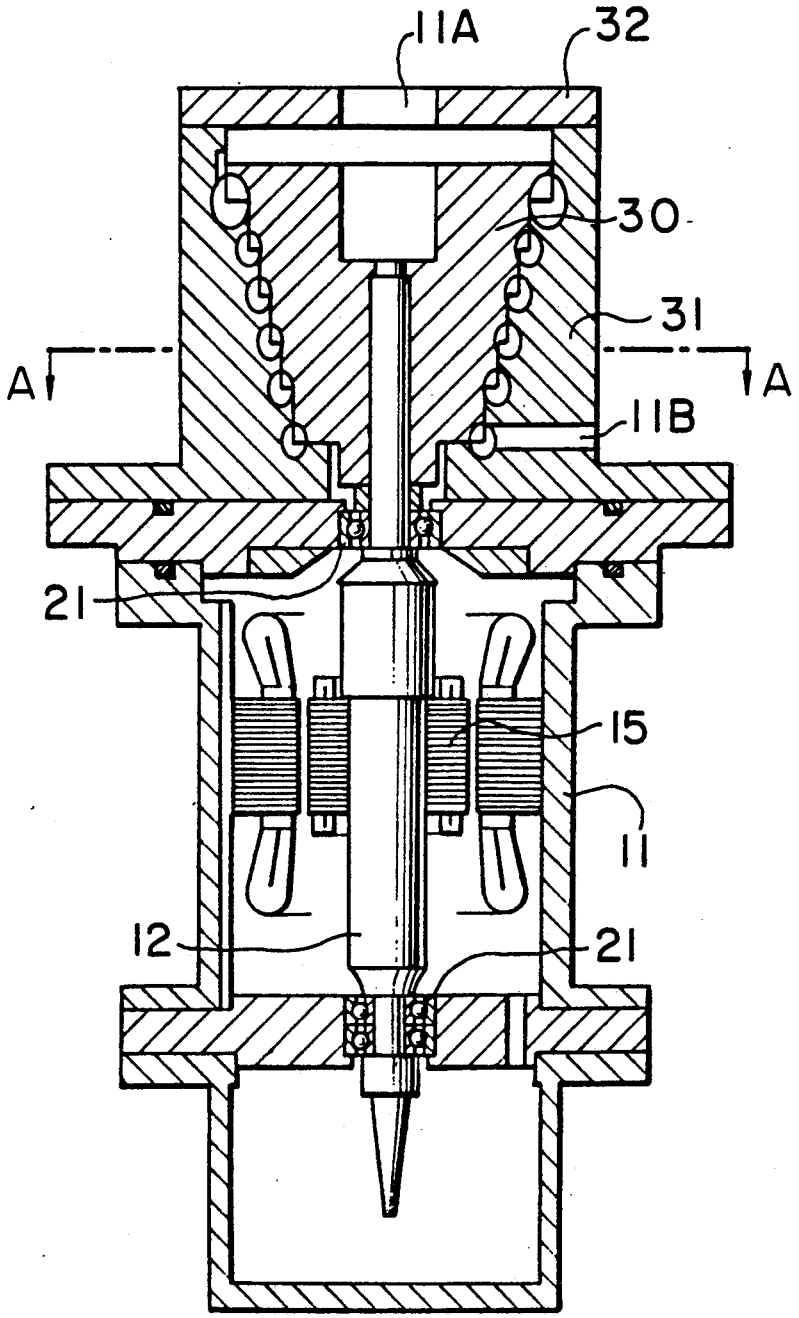
FIG. 1 is a longitudinal sectional view showing one embodiment of turbo vacuum pump according to the present invention.

As shown in FIG. 1, one embodiment of turbo vacuum pump according to the present invention is provided with a pump section composed of a peripheral-flow impeller 30, a stator 31 and a lid 32 and a driving section composed of a rotary shaft 12, which is supported by a bearing 21 for rotation about its axis within a housing 11, and a high-frequency motor 15 disposed on the rotary shaft 12.

Figure 2A:
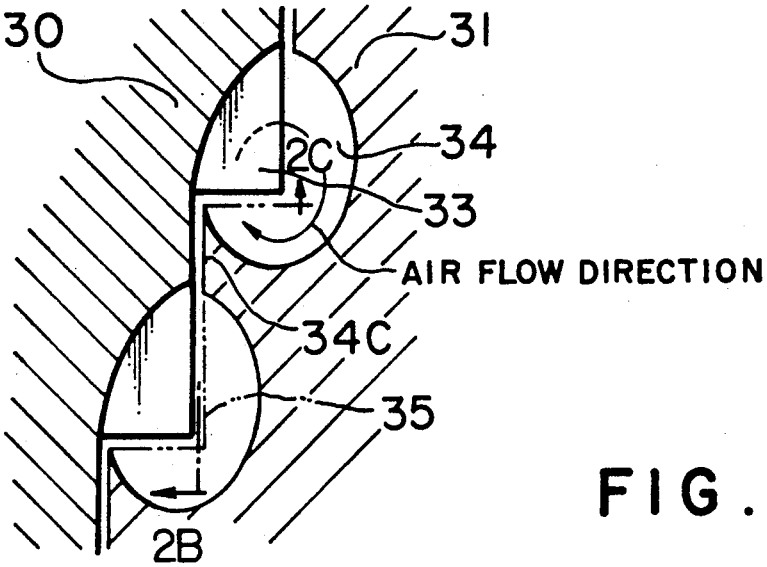
FIG. 2A is an enlarged longitudinal sectional view showing the blades of the peripheral-flow impeller of FIG. 1.

The peripheral-flow impeller 30 has a substantially conical form whose outer diameter increases in one direction like a staircase, as shown in FIG. 2A, and a plurality of blades 33 are fixed to a convex corner of each step.

Figure 2B:
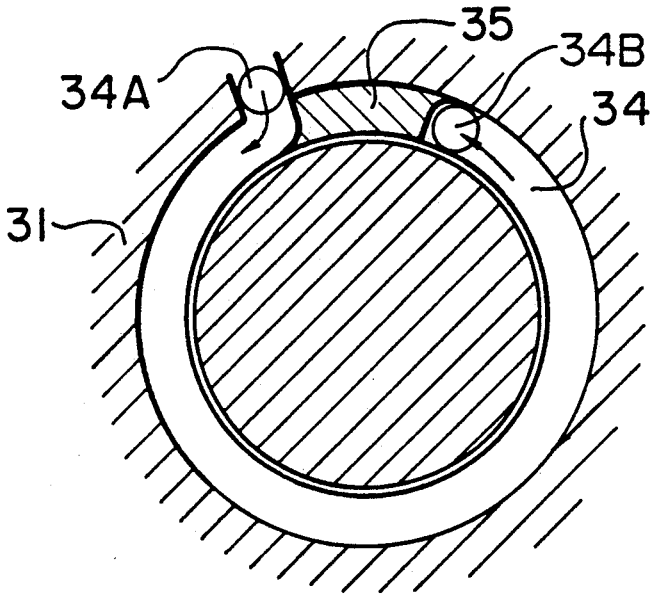
FIG. 2B is an enlarged cross-sectional view taken in the direction of the arrow 2C of FIG. 2A.

As shown in FIGS. 2A and 2B, the stator 31 is opposes to the peripheral-flow impeller 30 with a small gap therebetween. Peripheral flow passages 34 are formed so as to surround the blades 33 of the peripheral flow impeller 30, and strippers (or septums) 35 are formed in such a manner that inlet ports 34A and outlet port 34B are arranged near the opposite ends of strippers respectively to communicate with the peripheral flow passages 34.

In this manner, the peripheral-flow impeller 30 and the stator 31 are opposed the each other in a manner of cylindrical staircase-shape whose diameter increases in one direction. Accordingly, even if the peripheral-flow impeller 30 and the stator 31 are formed by integral molding, it is possible to assemble or disassemble them by shifting them with respect to each other in the axial direction.

The operation of the above embodiment will be explained below.

A gas, which has been sucked through a suction port 11A, enters the peripheral flow passage 34 through the inlet port 34A and then flows into the spaces between the blades 33 of the peripheral-flow impeller 30. The gas is accelerated in the radial direction by the blades 33 which are rotating at high speed, and is discharged from the spaces between the blades 33 in the radial direction by centrifugal force. The discharged gas decelerates within the peripheral flow passage 34 and, after the pressure of the gas rises, the gas again enters between the blades 33 in a swirl manner as shown by an arrow in FIG. 2A.

Subsequently, the gas repeats the abovedescribed process a plurality of times within the peripheral flow passage 34 while flowing in the peripheral flow passage 34. Accordingly, since the gas flows spirally through the peripheral flow passage, it can obtain a sufficient amount of energy from the peripheral-flow impeller 30.

Accordingly, in accordance with the above embodiment a high compression ratio can be obtained.

Figure 2C:
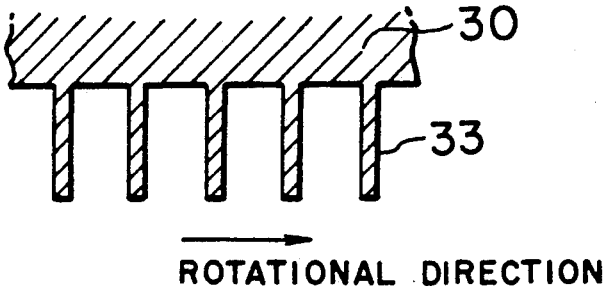
FIG. 2C is an enlarged cross-sectional view of the blades taken in the direction of the arrow 2B of FIG. 2A.
Figure 3:
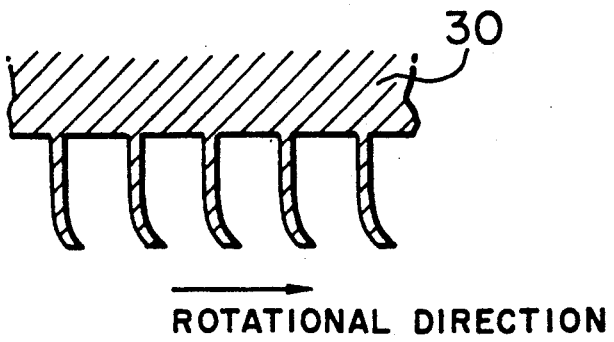
FIG. 3 is an enlarged cross-sectional view showing another example of the blades.

In addition, if the ease of production is important, each of the blades 33 may be shaped in an straight form as shown in FIG. 2C. If an improvement in pump performance is important, the ends of blades of the inlet side of the spirally flowing gas may be formed in such a manner as to be curved in the direction of gas flow, as shown in FIG. 3.

The gas between the peripheral-flow impeller and the stator 31 cause the pump performance to deteriorate to the greatest extent around the portions of seals 34c between the pump stages, but the influence of the gap 35A of stripper by which the blades 33 can pass with compressed gas retained therebetween is relatively small.

In this embodiment, as shown in FIG. 2A, since the radial gaps of the seals 34c between the pump stages cause a deterioration in the performance, control of these gaps is important and axial gaps may be made large to some extent.

Figure 4:
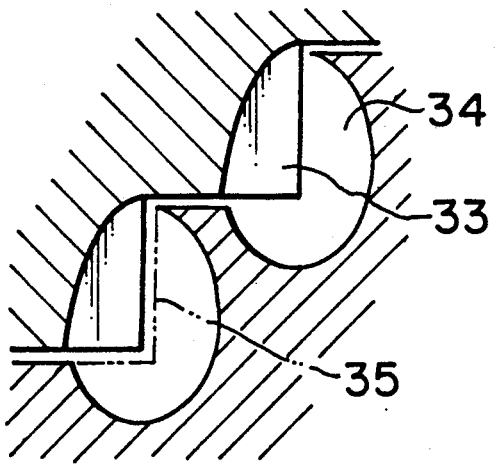
FIG. 4 is an enlarged longitudinal sectional view showing the blades of another embodiment of turbo vacuum pump according to the present invention.

On the other hand, if the radial gaps of the seals 34c between the pump stages are to be made large, the pump needs only to be formed into a configuration which enables only the axial gaps to be formed in the seals 34c between the pump stages as shown in FIG. 4.

More specifically, as shown in FIG. 4, only the axial gaps in the seals 34c between the pump stage can be formed by forming the seals 34c in the radial direction. With this arrangement, it is possible to prevent large deterioration in pump performance at each stage.

Figure 5:
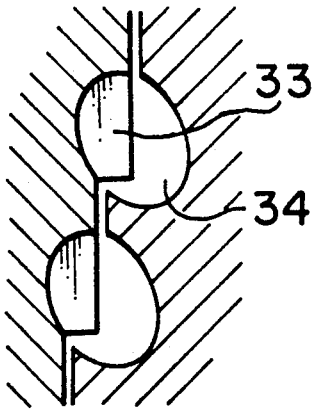
FIG. 5 is an enlarged longitudinal sectional view showing the blades of the other embodiment of turbo vacuum pump according to the present invention.

If the seals 34c have radial gaps as shown in FIG. 2A, the differences in diameter between the steps of the impeller 30 may be made smaller than the heights of the blade 33 as shown in FIG. 5.

In this case, since the seals 34c have radial gaps, the performance of the pump may deteriorate to a slight extent, but the differences in diameter between the steps of the impeller 30 can be made small as compared to the case where the radius ratio of the peripheral-flow impeller 30 at each stage is fixed, which impeller has the inlet port 34A and the outlet port 34B for each peripheral flow. Accordingly, since the number of stages of the pump can be increased, it is possible to realize larger compression ratio.

Figure 6A:
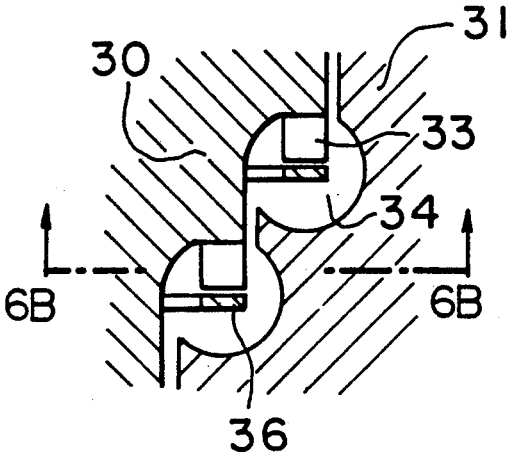
FIG. 6A is an enlarged longitudinal sectional view showing the blades of the other embodiment of multi pump-stage peripheral-flow type of vacuum pump according to the present invention.
Figure 6B:
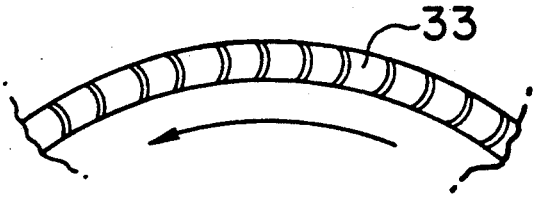
FIG. 6B is a view taken along the line 6B—6B of FIG. 6A.

In a pump whose seals 34c between the pump stages have radial gaps as shown in FIG. 2A, if the blades 33 and cores 36 are provided at the corner portions of the respective steps of the impeller 30 as shown in FIGS. 6A and 6B, it is possible to obtain a pump having higher performance.

More specifically, since the seals 34c have radial gaps a high compression ratio can be easily obtained because of the characteristics of individual pump elements. Accordingly, it is possible to decrease the number of stages of the pump.

Another embodiment of the present invention will be explained below with reference to FIG. 7.

Figure 7:
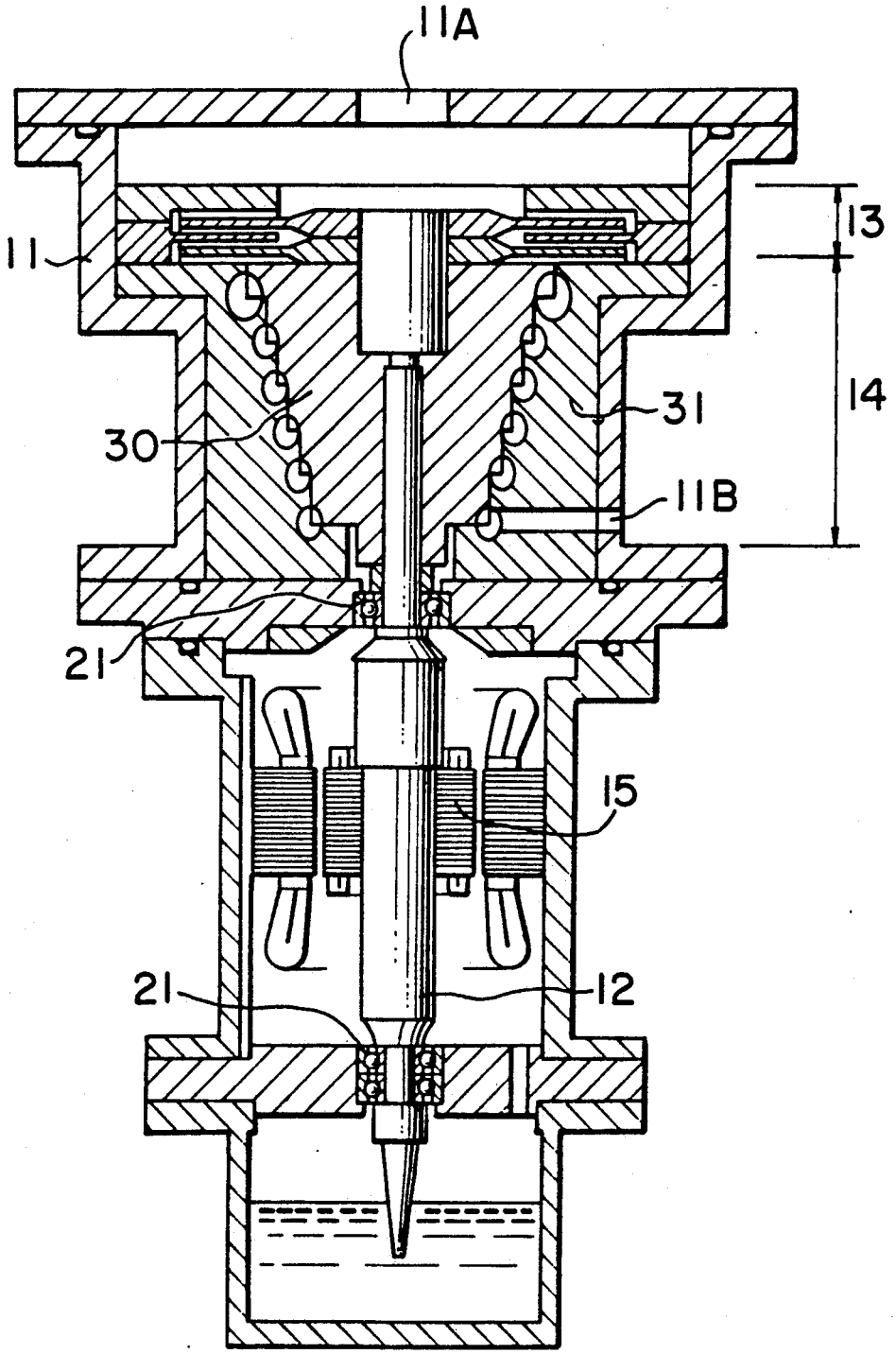
FIG. 7 is a longitudinal sectional view showing the other embodiment of turbo vacuum pump according to the present invention.

As shown in FIG. 7, this embodiment differs from the embodiment shown in FIG. 1 in that a radial-flow pump stage 13 is provided within the housing 11 having the outlet port 11B, in addition to peripheral-flow pump stages 14' composed of the stator 31 and the impeller 30 shown in FIG. 1. Since the other elements are the same as the corresponding elements shown in FIG. 1, they are denoted by the same reference numerals as those used in FIG. 1.

As described previously, in the embodiment shown in FIG. 1, a high compression ratio can be obtained by utilizing the operation in which the peripheral-flow pump stages 14' impart velocity energy to the flow of gas and generate pressure.

Accordingly, although good performance can be achieved within a viscous-flow pressure region, the above operation will be made less effective in the pressure region of a transient flow or a molecular flow.

As a result, the ultimate pressure of the vacuum pump is limited to several Torr or more at which the viscous flow is maintained.

For this reason, in the embodiment shown in FIG. 7, in order to insure an ultimate pressure corresponding to the molecular-flow pressure region, a radial-flow-pump stage 13, which is a conventional pump for the transient flow and the molecular flow, is provided on the low-pressure side of the peripheral-flow-pump stages 14'.

Accordingly, if the pressure between the radial-flow-pump stage 13 and the peripheral-flow-pump stages 14' is several Torr, the ultimate pressure of the present embodiment of the vacuum pump can be decreased to $10^{-4}$ or $10^{-5}$ Torr.

In addition, in the present embodiment, as shown in FIGS. 2C and 3, the blades 33 can be formed into a suitable configuration in accordance with the ease of production or the performance of the pump.

The gap between the peripheral-flow impeller 30 and the stator 31 may cause the pump performance to deteriorate to the greatest extent at the portions of the seals 34c between the pump stages, but the influence of the gaps 35A of the strippers 35, by which the blades 33 pass with compressed gas retained therebetween, is relatively small.

In this embodiment, as shown in FIG. 2A, since the radial gaps of the seals 34c between the pump stages cause a deterioration in the performance to large extent, control of this gap is important and an axial gap may be made large to some extent.

On the other hand, if the radial gaps of the seal 34c are to be made large, the pump needs to be formed into a configuration in which only the axial gaps are formed at the seals 34c between the pump stages as shown in FIG. 4.

Although the above embodiment utilizes the radial-flow-pump stage, the present invention is not limited to this arrangement. For example, an axial flow screw pump having the function of a molecular drag pump or an axial-flow molecular pump utilizing blades having small height may be employed.

Figure 8:
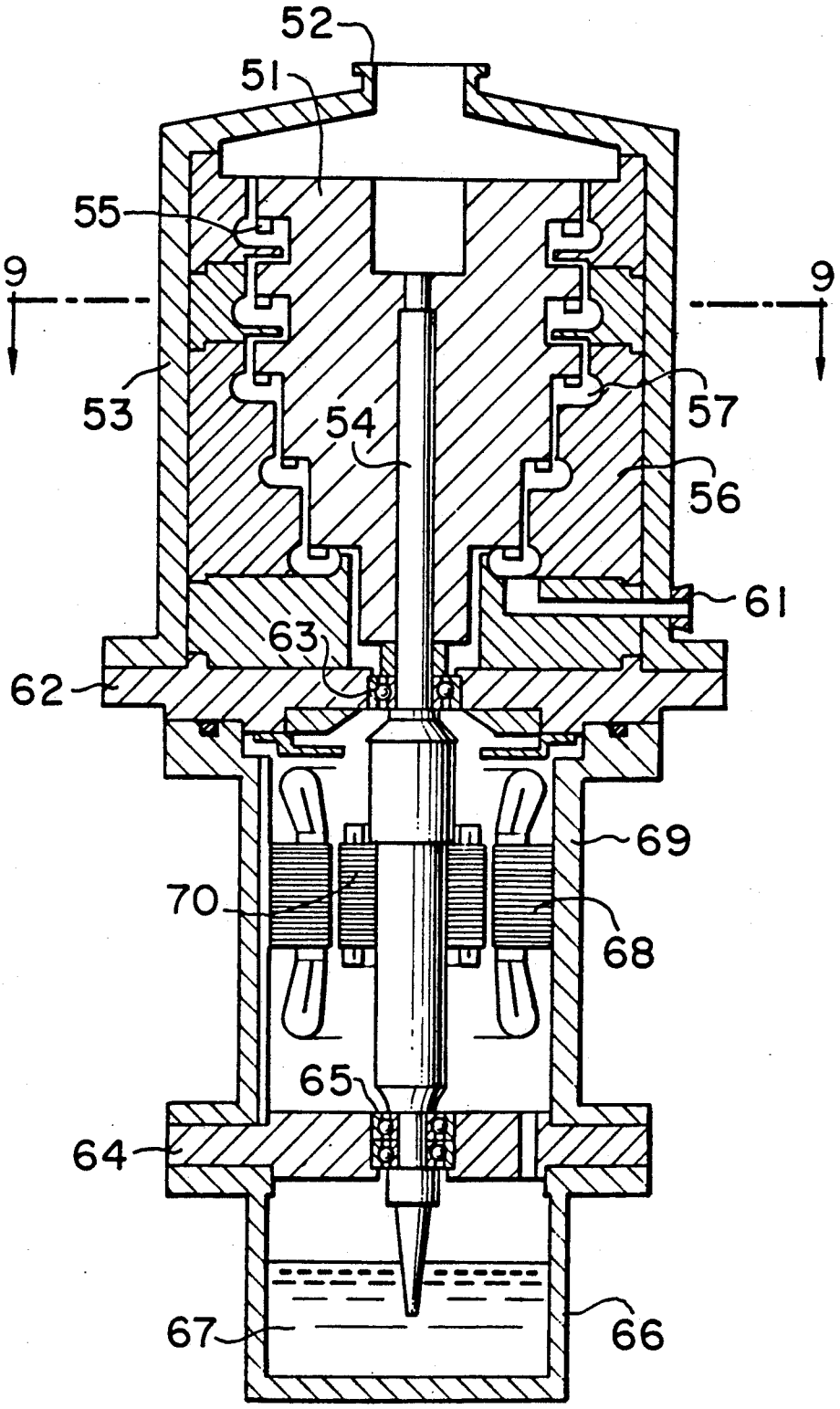
FIG. 8 is a longitudinal sectional view showing the other embodiment of turbo vacuum pump according to the present invention.

Still another embodiment of the present invention is shown in FIG. 8.

Figure 9:
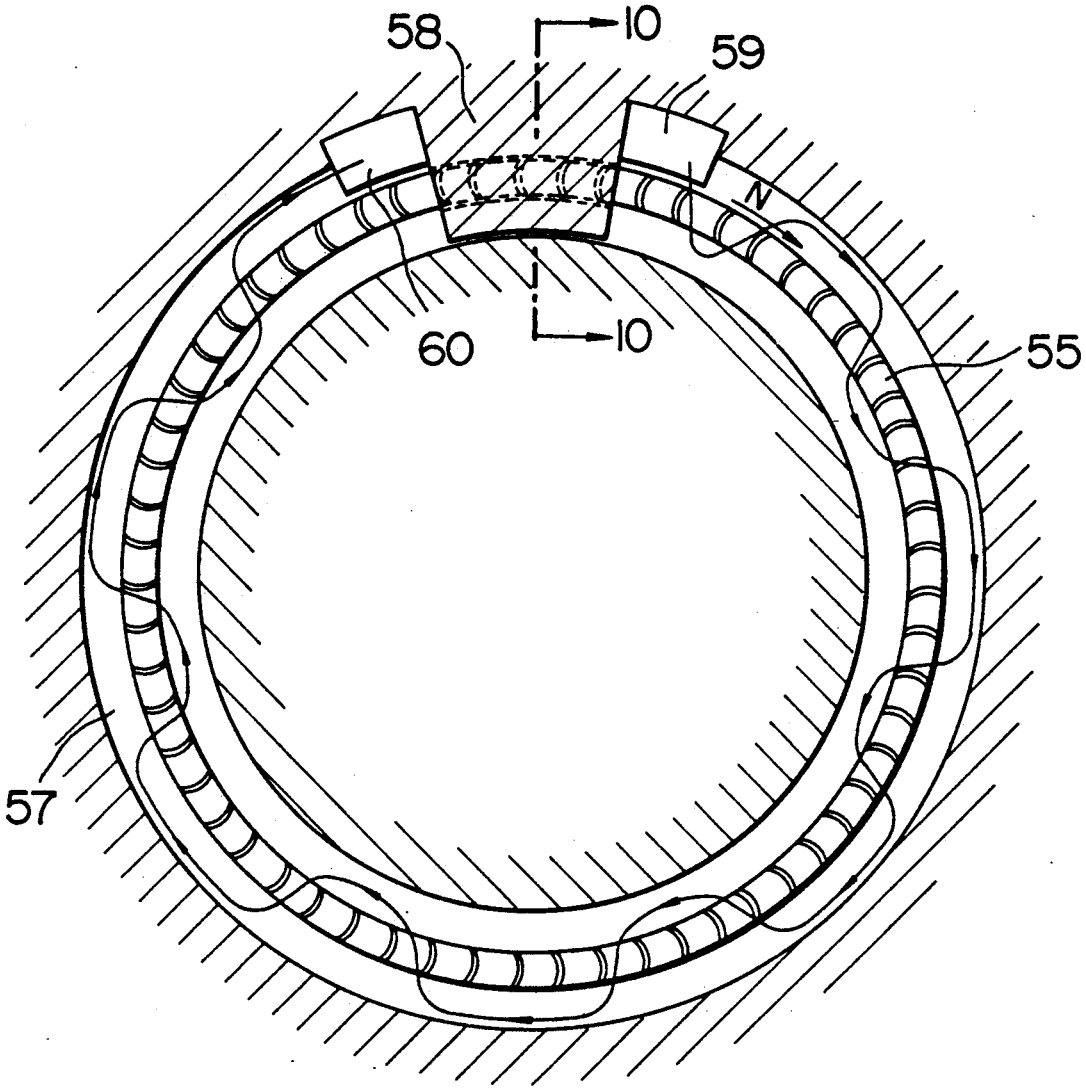
FIG. 9 is a cross-sectional view taken along the line 9—9 of FIG. 8.
Figure 10:
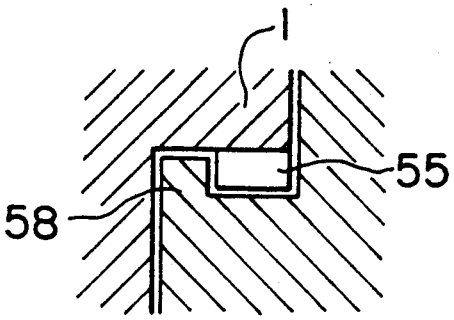
FIG. 10 is a cross-sectional view taken along the line 10—10 of FIG. 9.

As shown in FIG. 8, a rotor 51 is disposed in a casing 53 provided with an inlet port 52 and an outlet port 61, and is shrinkage-fitted onto a shaft 54. The rotor 51 has annular portions extending axially from the outer circumference side of the rotor 51, and the annular portions are formed into blades 55. The blades 55 are composed of forward arc blades as shown in FIG. 9. Peripheral flow passages 57 are defined between the blades 55 and the inner circumference of the peripheral-flow pump stator 56 which is opposed to the blades 55. As shown in FIG. 9, a stripper 58 is formed on each of the peripheral flow passages 57 at one circumferential position thereof. The strippers 58 are formed to substantially occupy all the spaces on the inner circumferential side, the outer circumferential side, and the axial side of the rotor 51, as shown in FIG. 10. Suction ports 59 and discharge ports 60 are formed on the forward and reverse sides of the strippers 58 respectively as viewed in the rotating direction N. The aforesaid shaft 64 is supported through a bearing 63 supported by a base 62 and through a bearing 65 supported by a base 64. Lubrication for the bearings 63 and 65 is achieved by sucking a lubricating oil 67 stored in an oil tank 66 through the center of the shaft 54. The rotor 51 is driven by a motor stator 69 which is fixed in a motor casing 68 and by a motor rotor 70 which is fixedly fitted on the shaft 54 and is rotatably inserted in the motor stator 69.

The operation of the above turbo vacuum pump is explained below.

When the rotor 51 is driven at high speed by the motor rotor 70 and the stator 69, gas molecules are sucked from the inlet port 52 and discharged through the outlet port 61 by the operation of the peripheral-flow pump. A vacuum vessel (not shown) connected to the inlet port 61 can be evacuated by this pumping operation. In this case, in order to realize effective discharging operation, it is important to enhance the performance of the peripheral-flow pump. For this reason, this embodiment is provided with the peripheral-flow pump which comprises the forward arc blades 55 formed on the axially extending annular portion of the rotor 51 and the peripheral flow passages 57 which are defined between the forward arc blades 55 and the peripheral-flow-pump stator 56 which is opposed to the arc blades 55 in the axial direction. In this type of peripheral-flow pump, spaces communicating with the flow passages 57 can be provided on the inner-circumferential sides and the outer-circumferential sides of the blade 55. Accordingly, a flow which passes through the spaces between the blades 55 in the radial direction from the inner-circumferential side to the outer-circumferential side can be effectively generated, whereby the action of centrifugal force can be sufficiently utilized. In addition, the flow is directed in the direction of the arrow shown in FIG. 10 by the forward arc blades 55 so that energy can be imparted to the ga molecules.

Accordingly, the peripheral-flow pump of the type according to the above embodiment has a higher compression ratio than conventional peripheral-flow pumps, whereby even higher performance can be achieved.

In addition, as the compression ratio of the peripheral-flow pump is made larger, the compression ratio of the entire turbo vacuum pump becomes larger. Accordingly, even higher-performance turbo vacuum pumps can be achieved.

Moreover, in the above embodiment, the outer diameter of the peripheral-flow pump which operates on a high-pressure discharge side is made gradually smaller toward the discharge side. Accordingly, the above embodiment also has a merit in that the disc friction loss of the peripheral-flow pump is small and the motor capacity can also be made small.

Still another embodiment of the present invention is explained with reference to FIG. 11.

Figure 11:
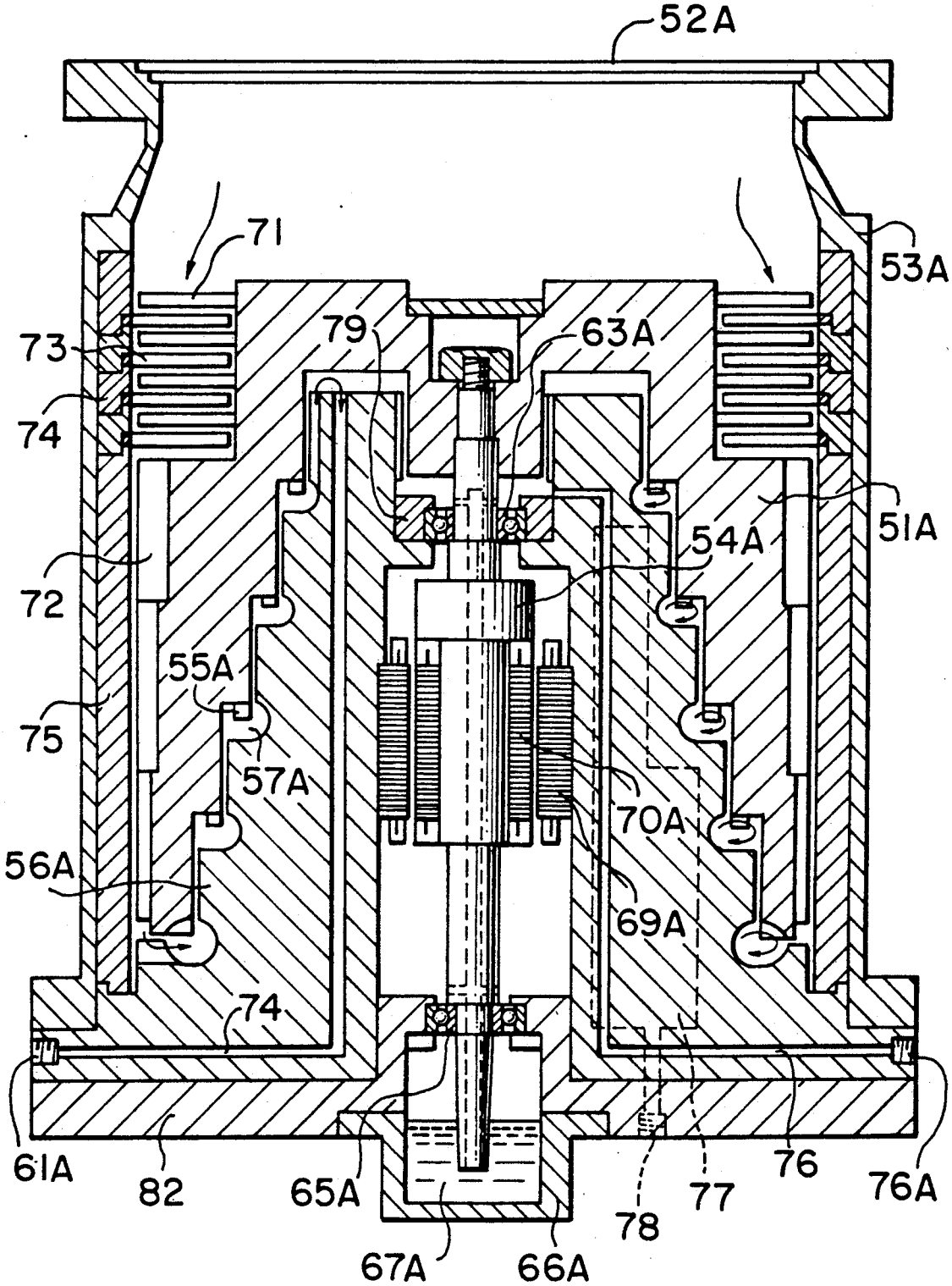
FIG. 11 is a longitudinal sectional view showing the other embodiment of turbo vacuum pump according to the present invention.

As shown in FIG. 11, a rotor 51A is disposed in a casing 53A provided with an inlet port 52A, and is shrinkage-fitted onto a shaft 54A. Axial-flow vane rotors 71 and a spiral groove molecular pump 72 are provided on the outer circumference of the rotor 51A in that order from the inlet port 52A. The axial-flow blade rotors 71 are opposed to axial-flow blade stators 73 in the axial direction. The axial-flow blade stators 73 are supported on a peripheral-flow-pump stator 56A via spacers 74 and 75. Blades 55A are formed on portions axially extending in the inner-circumferential side of the rotor 51A. The blades 55A are forward arc blades as shown in FIG. 9. Peripheral flow passages 57A are defined between the blades 55A and the peripheral-flow-pump stator 56A which is opposed to the blades 55A in the axial direction. As shown in FIG. 9, a stripper 58A is formed in each of the peripheral flow passages 57A at one circumferential position thereof.

The strippers 58A are formed to substantially occupy all the spaces on the inner circumferential sides, the outer circumferential sides, and the axial sides of the rotor 51A, as shown in FIG. 10. Suction ports 59A and discharge ports 60A are formed respectively on the forward and reverse sides of the stripper 58A as viewed in the rotating direction N.

In multiple stages of peripheral-flow pump having the above-described construction, individual steps have diameters which become smaller from the inlet side to the outlet side in step-by-step fashion. The peripheral-flow-pump stator 56A is provided with a discharge passage 74, an outlet port 61A, a purge-gas channel 76, a purge-gas port 76A, a cooling-water jacket 77, and a cooling-water port 78. The aforesaid shaft 54A is supported through a bearing 63A supported by the peripheral-flow-pump stator 56A via a bearing holding member 79, and through a bearing 65A supported on a lower casing 82. Lubrication of the bearings 63A and 65A is achieved by sucking a lubricating oil 67A stored in an oil tank 66A through the center of the shaft 54A. The rotor 51A is driven by a motor rotor 70A disposed in the middle of the shaft 54A and by a motor stator 69A supported by the peripheral flow-pump stator 56A.

The operation of the above turbo vacuum pump is explained below.

When the rotor 51A is driven at high speed, gas molecules are sucked from the inlet port 52A and fed to the outlet port 61A in which atmospheric pressure is maintained, in accordance with the rotary operation of the axial-flow vane rotor 71, the axial-flow blade stator 73, the spiral groove molecular pump 72 and the peripheral-flow pump. Therefore, an ultra-high vacuum can be generated in a vacuum vessel (not shown) connected to the inlet port 52A. In this case, in order to realize effective pumping operation, it is important to enhance the performance of each discharging element, particularly the peripheral-flow pump. For this reason, this embodiment is provided with the peripheral-flow pump which comprises the forward arc blades 55A formed on the annular portions which extend from the rotor 51A in the axial direction and the peripheral flow passages 57A which is defined between the forward arc blades 55A and the peripheral-flow-pump stator 56A which is opposed to the arced blades 55 in the axial direction. Accordingly, a flow which passes through the spaces between the blades 55A in the radial direction from the inner-circumferential side to the outer-circumferential side can be effectively generated, whereby the action of centrifugal force can be sufficiently utilized. In addition, the flow is directed in the direction of the arrow shown in FIG. 9 by the forward arc blades 55A so that energy can be imparted to the gas molecules.

Accordingly, the compression ratio of the peripheral-flow pump of the type according to the above embodiment can be made higher as compared to conventional peripheral-flow pumps, whereby even higher performance can be achieved.

In addition, as the compression ratio of the peripheral-flow pump is made larger, the compression ratio of the entire turbo vacuum pump becomes larger, or the compression ratio of the axial-flow blade rotor 71 or of the spiral groove pump 72 decreases correspondingly so that the axial flow blades or discharging elements of the spiral groove molecular pump can effect a large pumping speed, therefore it is possible to increase the pumping speed of the turbo vacuum pump.

Moreover, in the above embodiment, a plurality of peripheral-flow-pump stages are arranged such that the outer diameters thereof become gradually smaller from the inlet side to the outlet side in step-by-step fashion. Accordingly, it is possible to integrally form the peripheral-flow-pump stator 56A, whereby assembly becomes easy and the ease of production can be remarkably improved.

In addition, since driving elements such as the peripheral-flow-pump stages, the motor, the bearings and the like are incorporated in the interior of the rotor 51A, the axial dimension can be made very compact.

Still another embodiment of the present invention will be explained below with reference to FIG. 12.

Figure 12:
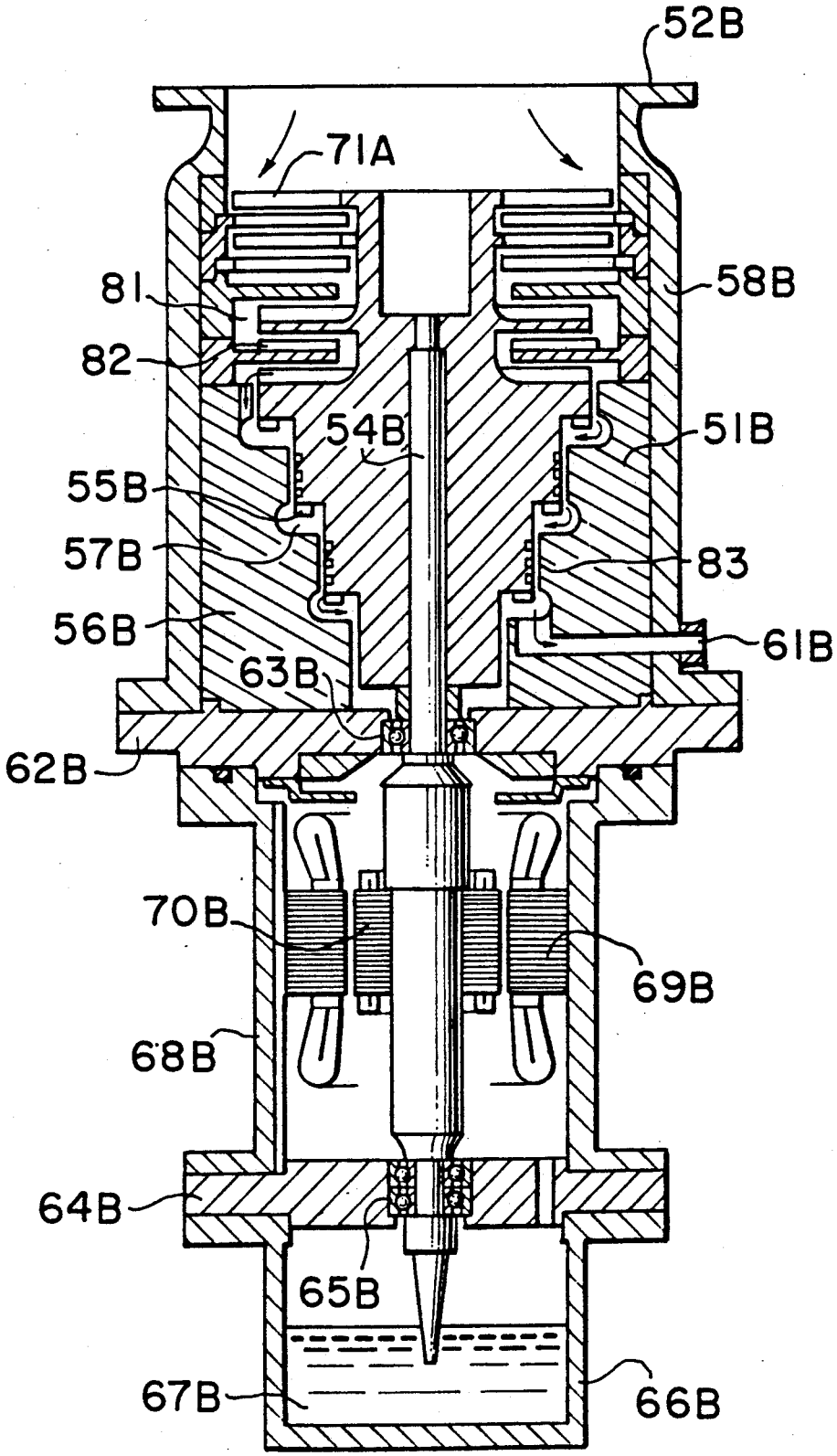
FIG. 12 is a longitudinal sectional view showing the other embodiment of turbo vacuum pump according to the present invention.

As shown in FIG. 12, a rotor 51B is disposed in a casing 53B provided with an inlet port 52B, and is shrinkage-fitted onto a shaft 54B. The rotor 51B is provided with axial-flow blade rotors 71A and radial-flow blade rotors 80 on a side nearer to the inlet port 52B. Axial-flow blade stators 73A are opposed to the axial-flow vane rotors 71A, and a radial-flow blade stator 82 is disposed in a return flow passage 81. Blades 55B are formed at each axially projecting annular portion of the rotor 51B on the side nearer to an outlet port 61B. Peripheral flow passages 57B are defined between the blades 55B and the peripheral-flow-pump stator 56B which is opposed to the blades 55B in the axial direction. The peripheral-flow-pump stator 56B is provided with the outlet port 61B. In addition, multiple stages of peripheral-flow pumps composed of the blades 55B and the corresponding peripheral flow passages 57B are provided, and the diameters of the respective stages become gradually smaller from the inlet side to the outlet side in step-by-step fashion. Moreover, labyrinth seals 83 for preventing reverse flow of gas molecules from the high-pressure side to the low-pressure side are arranged between the pump stages. The aforesaid shaft 54B is supported through a bearing 63B supported by a base 62B and through a bearing 65B supported by a base 64B. Lubrication of the bearings 63B and 65B is achieved by sucking a lubricating oil 57B stored in an oil tank 66B through the center of the shaft 54B The rotor 51B is driven by a motor rotor 70B disposed in the center of the shaft 54B and a motor stator 69B supported by the peripheral-flow-pump stator 56B.

The operation of the above turbo vacuum pump is explained below.

When the rotor 51B is driven at high speed by the motor rotor 70B and the motor stator 69B, gas molecules are sucked from the inlet port 59B and discharged through the outlet port 61B by the rotary operation of the axial-flow blade rotor 71, the radial-flow-blade rotor 80 and the peripheral flow pump. An ultra-high vacuum can be generated in a vacuum vessel (not shown) connected to the inlet port 59B by this discharging operation.

In order to realize effective pumping operation, it is important to enhance the performance of the peripheral flow pump.

For this reason, this embodiment employs the high-performance peripheral-flow pump explained in the above embodiment and, in addition, the labyrinth seals 83 for preventing reverse flow of gas molecules from the high-pressure side to the low-pressure side are arranged between the pump stages. Accordingly, it is possible to further enhance the performance.

Accordingly, a high-performance turbo vacuum pump can be provided. Moreover, since the peripheral-flow-pump stator 56B can also be integrally formed like that of the embodiment shown in FIG. 8, the ease of production can be improved.

In the description of each of the embodiments, the producing method for the stator 56, 56A or 56B of the peripheral-flow pump is not referred to. However, if this stator 56, 56A or 56B is produced by a precise investment casting method, the respective gaps between the rotors 51, 51A, 51B and the stators 56, 56A, 56B, which may seriously influence the performance of the peripheral-flow pump, can be made small, whereby it is possible to enhance the performance of the peripheral-flow-pump.

In each of the above-described embodiments, no liquid such as oil is present in the flow passage for gas molecules, whereby oil-free evacuation can be performed. Accordingly, any of the above embodiments is suitable for use in evacuation of a semiconductor manufacturing apparatus.

Figure 13:
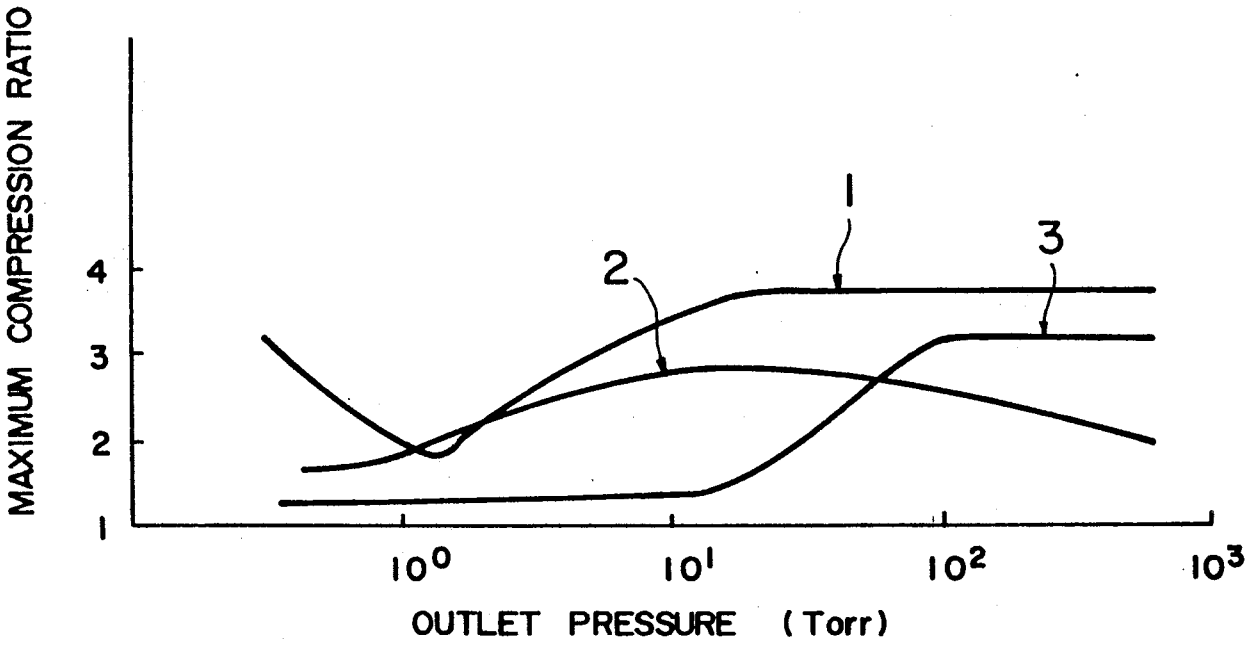
FIG. 13 is a graphic representation showing a comparison between the performance achieved by the present invention and that of a prior art arrangement.

FIG. 13 shows the results of experiments which were conducted in order to compare the performance of the turbo vacuum pump according to one of the above embodiments with those of conventional peripheral-flow pumps. In FIG. 13, a curve (1) represents the performance of the turbo vacuum pump of the embodiment according to the present invention a curve (2) represents the performance of a conventional type of vacuum pump, and a curve (3) represents the performance of another conventional type of vacuum pump disclosed in Japanese Patent Unexamined Publication No. 63-147989.

As apparent from FIG. 13, the turbo vacuum pump of the embodiment of the invention realizes a large compression ratio, hence higher performance, as compared to the conventional vacuum pumps, over the wide pressure range between several hundreds m Torr and 760 Torr (atmospheric pressure).

What is claimed is:

1. A vacuum pump comprising a housing having an inlet port and an outlet port, a rotary shaft rotationally supported in said housing, a multistage peripheral-flow impeller supported by said rotary shaft, and a stator constituting a multistage peripheral-flow pump in cooperation with said peripheral-flow impeller within said housing so that a gas suctioned through said inlet port is discharged through said outlet port, said multistage peripheral flow impeller having a conical cross-sectional configuration and including a plurality of steps defined about an outer periphery thereof, with each stp respectively defining a stage of the multistage peripheral flow impeller, said steps being spaced from each other in an axial direction of the impeller, outer diameters of the individual steps decreasing in a step-by-step fashion in a direction from the inlet side of the pump toward an outlet side thereof such that an outer diameter of the immediately preceding step is greater than a following step, and a plurality of circumferentially spaced blades arranged at each step at projecting corners thereof, and wherein said stator surrounds the outer periphery of said impeller, said stator includes a plurality of steps along an interior thereof in opposition to the respective steps of said peripheral flow impeller, inner diameters of the individual steps of the stator decrease in the direction from the inlet toward the outlet side of the vacuum pump in a step-by-step fashion corresponding to said steps of said impeller, and said stator and said peripheral-flow impeller are dimensioned such that a small gap is provided between opposed surface portions thereof, and wherein said impeller and said stator can be assembled and disassembled from each other without disassembly of said stator.

2. A vacuum pump according to claim 1, wherein each of the steps of the stator includes at least a concave portion, and wherein a peripheral-flow-pump flow passage is defined along the concave portion of each of the steps of said stator.

3. A vacuum pump according to claim 1, wherein said peripheral-flow-pump flow passage communicating with another peripheral-flow-pump flow passage.

4. A vacuum pump according to claim 3, wherein said peripheral-flow pumps of said respective stages communicate with each other in series.

5. A vacuum pump comprising a housing having an inlet port and an outlet port, a rotary shaft rotationally supported in said housing, a multistage peripheral-flow impeller supported by said rotary shaft, and a stator constituting a multistage peripheral-flow pump in cooperation with said peripheral flow impeller within said housing so that a gas suction through said inlet port is discharged through said outlet port, said multistage peripheral-flow impeller having a cylindrical staircase shape including a plurality of steps respectively defining a stage of the multistage peripheral-flow impeller, outer diameters of the respective steps decreasing in a step-by-step fashion in a direction from the inlet port toward the outlet port such that an outer diameter of an immediately preceding step is greater than the outer diameter of a following step, said multistage peripheral-flow impeller having a plurality of blades at projecting corners of the respective steps, said stator having a staircase interior, inner diameters of the staircase shaped interior decreasing in the direction from the inlet side toward the outlet side in a step-by-step fashion corresponding to said cylindrical staircase shape of said impeller, and said stator being opposed to said peripheral-flow impeller with a small gap therebetween, and a peripheral-flow-pump flow passage defined along a concave portion of each of the steps of said staircase shaped interior, said peripheral-flow-pump flow passage communicating in series.

6. A turbo vacuum pump comprising a casing having an inlet port and an outlet port, multiple stage pumps arranged in an axial direction, each of said pumps including a rotor and a stator opposed to said rotor, said turbo vacuum pump being arranged to suction a gas through said inlet port and to discharge said gas through said outlet port, said pumps including at least one peripheral-flow pump comprising a plurality of individual stages respectively defined by a plurality of steps arranged about an outer periphery of the rotor of the peripheral-flow pump, said steps being spaced from each other in an axial direction of the pump, outer diameters of the individual steps decreasing in a step-by-step fashion in a direction from an inlet side of the pump to an outlet side thereof such that the outer diameter of an immediately preceding step is greater than the outer diameter of the following step, and wherein blades are formed on a portion of each of said steps and extend in the axial direction and a flow passage is defined along a circumferential portion of the stator of said peripheral-flow pump opposed to said blades in the axial direction.

7. A turbo vacuum pump according to claim 6 comprising labyrinth seals between the stages of said peripheral-flow pumps.

8. A turbo vacuum pump means comprising a casing having an inlet port and an outlet port and a plurality of multiple stage pumps axially disposed in said casing, each of said pumps including a rotor and a stator opposed to said rotor, said turbo vacuum pump means being adapted to suction a gas through said inlet port and to discharge said gas through said outlet port under atmospheric pressure, wherein one of said multiple stage pumps is a peripheral-flow pump comprising a plurality of individual stages respectively defined by a plurality of steps arranged about an outer periphery of the rotor of the peripheral-flow pump, said steps being spaced from each other in an axial direction of the pump, outer diameters of the individual steps decreasing in a step-by-step fashion in a direction from an inlet of the pump to an outlet side thereof such that the outer diameter of an immediately preceding step is greater than the outer diameter of the following step, and wherein blades are formed on a portion of each of said steps and extend in the axial direction and a flow passage defined along a circumferential portion of said stator disposed in opposition to said blades in the axial direction, and wherein another of said multiple stage pumps is disposed about the outer circumference of said rotor of said peripheral-flow pump.

9. A turbo vacuum pump according to claim 9, wherein an inlet side of said rotor is provided with any of an axial-flow blade, a radial-flow blade and a spiral groove molecular pump.

10. A turbo vacuum pump comprising an inlet port and an outlet port, a multistage peripheral flow impeller supported in a housing of the pump by a rotary shaft, said multistage peripheral-flow impeller having a cylindrical shape and including a plurality of individual steps disposed about a periphery thereof such that each step defines a stage of the multistage peripheral-flow impeller, a plurality of projecting corners, and a plurality of sets of blades for the respective pump stages, said sets of blades being respectively disposed at the projecting corners of the respective steps of the impeller, a stator having a cylindrical shape and being adapted to surround the outer periphery of said multistage peripheral-flow impeller, said stator including a plurality of individual steps disposed about an interior thereof in opposition to corresponding individual steps of said multistage peripheral-flow impeller, seal means respectively formed between opposed surfaces of the steps of the multistage peripheral-flow impeller and corresponding steps of the stator, each of said seal means is arranged between pump stages adjacent to each other so as to define each pump stage, outer diameters of the individual steps of the multistage peripheral-flow impeller decrease with each pump stage in a direction from an inlet side thereof toward an outlet side thereof such that an outer diameter of an immediately preceding stage is greater than the outer diameter of the following stage, diameters of the steps of the stator decrease with every pump stage, and wherein each of said seal means extends in a radial region between a radial position of radially terminating ends of the blades of a large-diameter side pump stage and a radial position of radially terminating ends of the blades of a small diameter side pump stage in a pair of adjacent pump stages.

11. A turbo vacuum pump according to claim 10, wherein the individual steps of the stator includes a concave portion, and wherein a peripheral-flow-pump flow passage is defined along the concave portions of the steps of the stator.

12. A turbo vacuum pump according to claim 11, wherein adjacent peripheral-flow-pump flow passages are in communication with each other.

13. A turbo vacuum pump according to claim 12, wherein the pump stages are arranged in series.

14. A turbo vacuum pump according to claim 13, wherein said stator is fashioned as a unitary member.

15. A turbo vacuum pump according to claim 10, wherein one of an axial-flow blade rotor, a radial-flow blade rotor, and a spiral groove molecular pump is arranged at the inlet side of the vacuum pump.

16. A turbo vacuum pump comprising an inlet port and an outlet port, a cylindrical shaped impeller supported in a housing of the vacuum pump by a rotary shaft, said impeller including a plurality of projecting corners and a plurality of sets of peripheral-flow pump blades for pumping air out of said projecting corner and defining a plurality of pump stages, a stator having a surface corresponding to a shape of the impeller and disposed in opposition to said impeller so that at least one flow passage is defined between the impeller and the stator, said plurality of peripheral-flow pump blades projecting axially from the respective projecting corners so that the flow passage extends to both radial sides of said peripheral-flow pump blades, and wherein said plurality of pump stages are respectively defined by a plurality of steps arranged about an outer periphery of the rotor of the peripheral-flow pump, said steps being spaced from each other in an axial direction of the pump, outer diameters of the individual steps decreasing in a step-by-step fashion in a direction from an inlet side of the pump to an outlet side thereof such that the outer diameter of an immediately proceeding step is greater than the outer diameter of the following step.

17. A turbo vacuum pump according to claim 16, wherein the peripheral flow pump blades are fashioned as blades curving in a direction of flow through the pump.

18. A turbo vacuum pump according to claim 17, wherein at least one labyrinth seal means is arranged between adjacent pump stages.

19. A turbo vacuum pump according to claim 16, wherein at least one labyrinth seal means is arranged between adjacent pump stages.

20. A turbo vacuum pump according to claim 16, wherein one of an axial-flow blade rotor, a radial-flow blade rotor, and a spiral groove molecular pump are provided at an inlet side of the vacuum pump.

21. A turbo vacuum pump comprising an inlet port and an outlet port, a multistage peripheral-flow impeller supported in a housing of the vacuum pump by a rotary shaft, said multistage peripheral-flow impeller having a stepped configuration such that an outer diameter thereof decreases stage-by-stage in a direction from an inlet side of the pump toward and outlet side thereof, each of said stages including a plurality of blades, and a stator disposed in opposition to the peripheral-flow impeller, said stator having a configuration corresponding to a configuration of the peripheral-flow impeller so as to define therewith a pump stage with each stage of the peripheral-flow impeller, and wherein the multistage peripheral-flow impeller includes a plurality of individual steps respectively defining the stages of the multistage peripheral-flow impeller and disposed about an outer periphery thereof and spaced from each other in an axial direction of the impeller, an outer diameter of the individual steps decreasing in a step-by-step fashion in a direction from the inlet side toward the outlet side of the vacuum pump such that the outer diameter of an immediately preceding step is greater than the outer diameter of a following step, an interior of the stator includes a plurality of steps having an inner diameter decreasing in a step-by-step fashion in a direction from the inlet side toward the outlet side of the pump, a small gap is defined between the peripheral-flow impeller and seal means are defined between adjacent pump stages.

22. A turbo vacuum pump according to claim 21, wherein the seal means include labyrinth seals.

23. A turbo vacuum pump according to claim 21, wherein the stator is formed as a unitary member.

24. A turbo vacuum pump according to claim 23, wherein the seal means include labyrinth seals.

25. A turbo vacuum pump according to claim 21, wherein each of the individual steps of the stator includes a concave portion, peripheral flow passages extend from the concave portions and the blades projecting axially from the stages of the peripheral flow impeller, and wherein each of the blades is an arcuate blade curving in a direction of flow through the pump.

26. A turbo vacuum pump according to claim 25, wherein the seal means include labyrinth seals.

27. A vacuum pump according to claim 1, wherein the multistage peripheral-flow impeller is fashioned as a unitary member.

28. A vacuum pump according to claim 1, wherein the stator is fashioned as a unitary member.

29. A vacuum pump according to claim 28, wherein the multistage peripheral-flow impeller is fashioned as a unitary member.

30. A vacuum pump according to claim 5, wherein said stator is fashioned as a unitary member.

* * * * *